US011851791B2

(12) United States Patent
Thorsen

(10) Patent No.: US 11,851,791 B2
(45) Date of Patent: Dec. 26, 2023

(54) FINGER CUFF FOR HANDLING YARN STRANDS

(71) Applicant: Jon Audun Thorsen, Lilleström (NO)

(72) Inventor: Jon Audun Thorsen, Lilleström (NO)

( * ) Notice: Subject to any disclaimer, the term of this patent is extended or adjusted under 35 U.S.C. 154(b) by 0 days.

(21) Appl. No.: 17/794,995

(22) PCT Filed: Apr. 16, 2021

(86) PCT No.: PCT/NO2021/050103
§ 371 (c)(1),
(2) Date: Jul. 25, 2022

(87) PCT Pub. No.: WO2021/235939
PCT Pub. Date: Nov. 25, 2021

(65) Prior Publication Data

US 2023/0183895 A1 Jun. 15, 2023

(30) Foreign Application Priority Data

May 20, 2020 (SE) ..... 20200599

(51) Int. Cl.
*D04B 3/04* (2006.01)

(52) U.S. Cl.
CPC ..... *D04B 3/04* (2013.01)

(58) Field of Classification Search
CPC ..... D04B 3/00; D04B 3/04; D04B 3/06
USPC ..... 66/1 R, 1 A
See application file for complete search history.

(56) References Cited

U.S. PATENT DOCUMENTS

| | | | | | |
|---|---|---|---|---|---|
| 1,208,085 | A * | 12/1916 | Branley | 242/153 | |
| 1,243,162 | A * | 10/1917 | Gruman | D15/78 | |
| 2,472,702 | A * | 6/1949 | Greenstein | D04B 3/00 | 66/1 A |
| 2,524,157 | A | 10/1950 | Viktoria | | |
| 4,037,433 | A * | 7/1977 | Weber | D04B 3/04 | 66/1 A |
| 4,370,870 | A * | 2/1983 | Kroh | D04B 3/00 | 66/1 A |
| 4,991,410 | A * | 2/1991 | Donatelli | D04B 3/04 | 66/1 A |
| 5,125,245 | A | 6/1992 | Clover | | |
| 11,060,217 | B2 * | 7/2021 | Rees | D04B 3/04 | |
| 11,499,252 | B2 * | 11/2022 | Ramsauer | D04B 3/04 | |

FOREIGN PATENT DOCUMENTS

JP 2002212862 7/2002

OTHER PUBLICATIONS

International Search Report Issued in PCT/NO2021/050103, dated Jul. 1, 2021, pp. 1-3.
Written Opinion Issued in PCT/NO2021/050103, dated Jul. 1, 2021, pp. 1-4.

* cited by examiner

*Primary Examiner* — Danny Worrell
(74) *Attorney, Agent, or Firm* — Jeffrey S. Melcher; Melcher Patent Law PLLC

(57) ABSTRACT

The invention relates to a knitting aid for use when knitting with more than one yarn. The finger cuff comprises a primary yarn strand guide, a secondary yarn strand guide, a transfer mechanism configured to at least shift the position of the secondary yarn strand guide in the finger cuff longitudinal direction between a first secondary yarn strand guide position and a second secondary yarn strand guide position.

14 Claims, 4 Drawing Sheets

FINGER CUFF FOR HANDLING YARN STRANDS

TECHNICAL FIELD

The disclosure relates to a knitting aid for use when knitting with more than one yarn.

BACKGROUND

Multiple colour hand knitting with two or more yarns is by many considered as a challenging endeavour, inter alia because of problems related to loop formation on the reverse side of the knitting and twisting of the yarns.

When simultaneously knitting with two or more yarns it may be that one knits several consecutive meshes using only one of the yarns before one changes over and knits one or more mesh(es) with the other yarn. Unless care is taken to regularly fasten the idle yarn, i.e. the yarn that at any given time is not being knitted, this knitting procedure will lead to the formation of long unwanted yarn strand loops on the reverse side of the knitting.

The above-mentioned problem with formation of long yarn strand loops on the reverse side of the knitting may as indicated be solved by regularly fastening any idle yarn strand(s) as one knits by bringing the idle yarn strand(s) into the knitting using the active yarn strand, i.e. the yarn strand that at any given time is being knitted. When knitting with two yarn strands for example the latter procedure typically involves an initial crossing of the two yarn strands before a mesh is knitted using the active yarn strand that brings the idle yarn strand into the knitting. As a consequence of said procedure it will be necessary for the knitter to keep track of the twisting of the yarns such that the two yarns don't continue to twist, and hence forms a tangle.

It is a goal of the present invention to improve on the handling of yarn strands for a knitter that knits with multiple yarns simultaneously.

SUMMARY OF THE INVENTION

The present invention provides a finger cuff for handling yarn strands when knitting with multiple yarns simultaneously, the finger cuff comprising: a primary yarn strand guide, a secondary yarn strand guide, and a transfer mechanism configured to at least shift the position of the secondary yarn strand guide in the finger cuff longitudinal direction between a first secondary yarn strand guide position and a second secondary yarn strand guide position, where the first secondary yarn strand guide position and the second secondary yarn strand guide position are located on opposite sides, in the finger cuff longitudinal direction, of the primary yarn strand guide.

The transfer mechanism comprises according to an embodiment of the invention a rail aligned at least in part along the longitudinal direction of the finger cuff, and a movable rail body, movable on the rail between a first rail body position and a second rail body position, where the secondary yarn strand guide is provided on or in the moveable rail body, and where the secondary yarn strand guide is positioned in the first secondary yarn strand guide position when the rail body is located in the first rail body position, and where the secondary yarn strand guide is positioned in the second secondary yarn strand guide position when the rail body is located in second rail body position.

According to another embodiment of the invention the rail comprises a hollow elongated element provided with two elongated recesses positioned diametrically opposite of each other and aligned in the longitudinal direction of the hollow elongated element, the primary yarn strand guide is provided on the outer surface of the hollow elongated element, the movable rail body comprises an elongated body provided with a transverse through hole or slot, where the elongated body is configured to move in the longitudinal direction of the hollow elongated element within the hollow elongated element, and wherein the transverse through hole or slot of the elongated body is alignable with the two elongated recesses of the hollow elongated element to form the secondary yarn strand guide.

According to yet another embodiment of the invention the finger cuff further comprises a finger cuff elongated part aligned in the longitudinal direction of the finger cuff, the finger cuff elongated part is provided with the primary yarn strand guide, the rail comprises a cart track, and wherein the movable rail body comprises a rail cart configured to be moveable along the cart track.

The rail body is according to yet another embodiment of the invention provided with an engagement point engageable with a knitting pin or a finger such that the rail body may be manually moved between the first rail body position and the second rail body position or vice versa.

The rail body is according to yet another embodiment of the invention provided with electrical moving means configured to move the rail body between the first rail body position and the second rail body position or vice versa.

The electrical moving means is according to yet another embodiment of the invention a solenoid mechanism or electrical motor.

The rail and/or rail body is/are according to yet another embodiment of the invention provided with holding means to prevent the rail body from moving unintentionally between the first rail body position and the second rail body position.

The holding means are according to yet another embodiment of the invention magnets.

The transfer mechanism comprises according to yet another embodiment of the invention a rotation element attachment means, and a rotation element, provided on the rotation element attachment means, where the primary yarn strand guide and the secondary yarn strand guide is provided in or on the rotation element, and where rotation of the rotation element shifts the position of the secondary yarn strand guide between the first secondary yarn strand guide position and the second secondary yarn strand guide position.

The finger cuff comprises according to yet another embodiment of the invention one or more additional yarn strand guides.

The finger cuff further comprises according to yet another embodiment of the invention a tertiary yarn strand guide, a second transfer mechanism configured to shift the tertiary yarn strand guide in the finger cuff longitudinal direction between a first tertiary yarn strand guide position and a second tertiary yarn strand guide position, where the first tertiary yarn strand guide position and the second tertiary yarn strand guide position are located on opposite sides of the primary yarn strand guide, and where the first tertiary yarn strand guide position and the second tertiary yarn strand guide position are located on opposite sides of first secondary yarn strand guide position or the second secondary yarn strand guide position.

Any one or more yarn strand guide comprise(s) according to yet another embodiment of the invention a pin, grove, through hole, slot or loop.

Other advantageous features will be apparent from the accompanying claims.

BRIEF DESCRIPTION OF THE DRAWINGS

In order to make the invention more readily understandable, the description that follows will refer to accompanying drawings, in which:

FIG. 2*a* is a schematic representation of a finger cuff comprising a secondary yarn strand guide, where the secondary yarn strand guide is positioned in a second secondary yarn strand guide position.

DETAILED DESCRIPTION OF THE INVENTION

In the following, general embodiments as well as particular exemplary embodiments of the invention will be described. References will be made to the accompanying drawings. It shall be noted, however, that the drawings are exemplary embodiments only, and that other features and embodiments may well be within the scope of the invention as claimed.

The present invention is based on a discovery that a specially designed finger cuff can be utilized to ease the handling of yarn strands when knitting with multiple yarns.

The present invention provides a finger cuff for handling yarn strands when knitting with multiple yarns simultaneously. The finger cuff comprises a primary yarn strand guide, a secondary yarn strand guide and a transfer mechanism.

Figure 1:
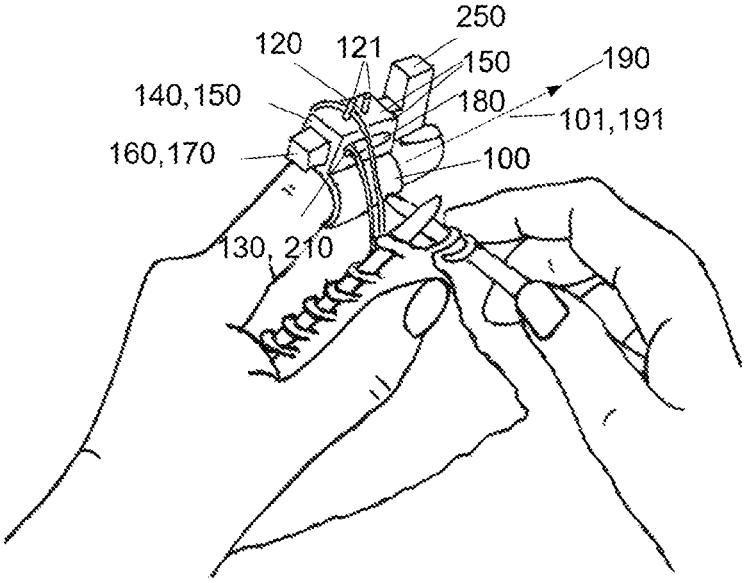
FIG. 1 is a schematic representation of finger cuff comprising a primary yarn strand guide, a secondary yarn strand guide, and a transfer mechanism.

A yarn strand guide may in the context of the present invention be considered as a feature of the finger cuff that may act to direct the longitudinal movement of a yarn strand while at the same time essentially restricting a transverse movement of the same yarn strand. A yarn strand guide may in other words be considered as a feature of the finger cuff through/in which a yarn strand may be thread, lead, placed or similar, which restricts the transverse movement of the yarn strand but allows for a longitudinal movement of the yarn strand. Examples of a yarn strand guide are pins, grove, through hole, slot or loop. A person skilled in the art with knowledge to the present invention will appreciate that any yard strand guide through/in which a yarn strand is thread, lead or placed etc., may allow for a slight transverse movement of the yarn stand, e.g. a few millimetres. An example of a yarn strand is shown in FIG. 1.

Any yarn strand guide may in any embodiment of the present invention generally be considered as aligned in a perpendicular fashion relative to the longitudinal direction of the finger cuff. The longitudinal direction of the finger cuff may be considered as the direction of the finger cuff that will align with that of the length of a finger when the finger cuff is worn by a user. A person skilled in the art with knowledge to the present invention will appreciate that the perpendicular alignment of any yarn strand guide is optional and that the exact alignment may vary.

The finger cuff comprises as mentioned above a primary yarn strand guide, a secondary yarn strand guide and a transfer mechanism. The transfer mechanism is according to the invention configured to at least shift the position of the secondary yarn strand guide in the finger cuff longitudinal direction, i.e. in the longitudinal direction of a finger when the finger cuff is worn on a such. The position of the secondary yarn strand guide may here be said to be interchangeable between a first secondary yarn strand guide position and a second secondary yarn strand guide position. The two said secondary yarn strand guide positions are according to the invention located on opposite sides of the primary yarn strand guide in the longitudinal direction of the finger cuff. When the finger cuff is worn by a user, the primary yarn strand position, and the first and secondary yarn strand guide positions may be arranged such that the first secondary yarn strand guide position is furthest towards the finger tip of the user, followed by the primary yarn strand position, and eventually by the second secondary yarn strand position. The latter is in this example consequently the yarn strand position that is positioned closest to the finger base of the three said yarn strand positions. It will be appreciated that the order of the yarn strand positions in the above example for symmetry reasons may be reversed.

A knitter knitting with two yarn strands that is employing the finger cuff may utilize the transfer mechanism to interchange the location of the two yarn strands in the longitudinal direction of his or her finger. The latter enables the knitter to controllably knit with whichever of the two yarn strands he or she desires while at the same time knit whichever one of the yarn strands that is idle into the knitting. As the knitter may controllably interchange the position of the two yarn strands back and forth as desired, the two yarn strands will not be tangled up during said knitting process.

The transfer mechanism comprises according to an embodiment of the invention a rail and a rail body movable on or in the rail. A rail and rail body may in the context of the present invention be interpreted broadly, but one may generally consider a rail body to be a body that may move within boundaries determined by the rail. Examples of a rail body and rail comprises any definition given later in this description, but also comprises examples such as a rod in a rod guide (i.e. similar as a pipecleaner in a pipe). The rail is here aligned at least in part along the longitudinal direction of the finger cuff, meaning that the longitudinal length of the rail will be aligned at least in part with the longitudinal direction of a finger when the finger cuff is worn on a such. It will be appreciated that that rail does not have to be aligned directly parallel with the longitudinal direction of the finger cuff, as the rail e.g. may be aligned with a slight tilt, with one or more bends, etc. The rail body is in the context of the invention movable on the rail between a first rail body position and a second rail body position. The two rail body positions may here generally be considered as located in two separate positions separated by a non-zero distance in the longitudinal direction of the finger cuff.

The secondary yarn strand guide is according to an embodiment of the invention provided on or in the moveable rail body. The secondary yarn strand guide is in other words moveable with the rail body on the rail such that the secondary yarn strand guide is be moved as the rail body is moved between the first and second rail body positions. The secondary yarn strand guide may thus be said to be positioned in the first secondary yarn strand guide position when the rail body is located in the first rail body position, and in the second secondary yarn strand guide position when the rail body is located in second rail body position.

Figure 2:
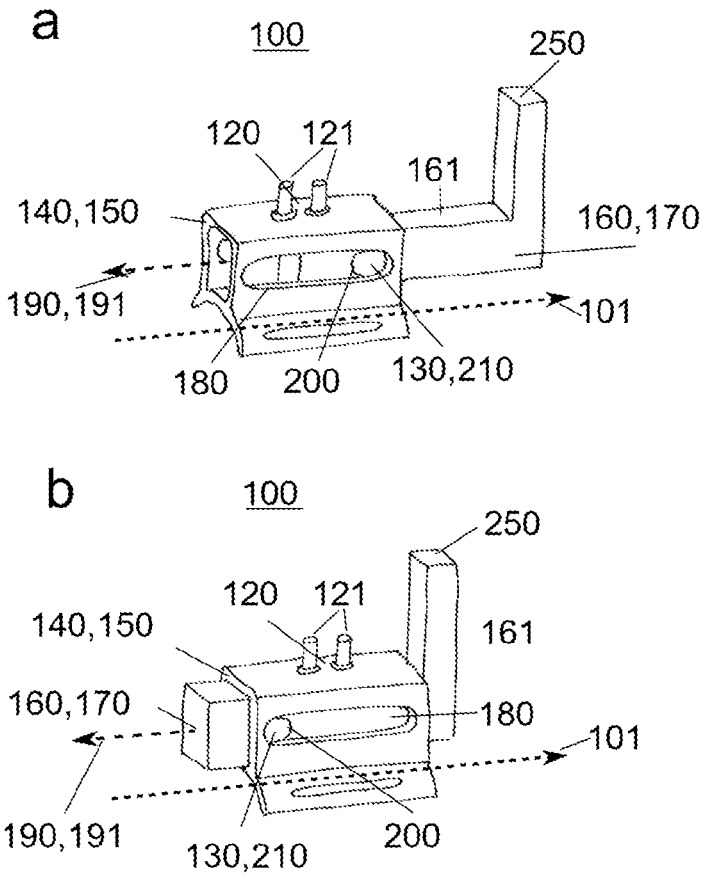
FIG. 2*a* is a schematic representation of a finger cuff comprising a secondary yarn strand guide, where the secondary yarn strand guide is positioned in a first secondary yarn strand guide position.

FIGS. 1 and 2 illustrates a finger cuff 100 where the rail 140 comprises a hollow elongated element 150 and where the movable rail body 160 comprises an elongated body 170. The hollow elongated element 150 and the elongated body 170 may be shaped according to each other, i.e. such that the elongated body 170 is shaped to fit at least in part inside the hollow elongated element 150 and to be movable longitudinally back and forth inside the hollow elongated element 150. It will be appreciated by a person skilled in the art with knowledge of the present invention that the exact shape and dimension of the hollow elongated element 150 and the elongated body 170 may vary. The hollow elongated element 150 and the elongated body 170 may e.g. be a hollow elongated three-dimensional rectangle or cylindrical tube and an elongated three-dimensional rectangle or cylindrical rod respectively.

The hollow elongated element 150 described above may as illustrated in FIGS. 1 and 2 be provided with two elongated recesses 180 positioned diametrically opposite of each other and aligned, or at least in part aligned, in parallel with the longitudinal direction 190 of the hollow elongated element. The elongated body 170 may be provided with a transverse through hole or slot 200 that may be aligned with the two elongated recesses 180 of the hollow elongated element 150 such that a through opening 210 is formed from a traverse side of the hollow elongated element to a diametrically opposite side of the hollow elongated element. Said through opening 210 thus goes through both the hollow elongated element 150 and the elongated body 170, and the movability of the elongated body 170 results in the through opening 210 being movable along the longitudinal axis 191 of the hollow elongated element 150. It will be appreciated that the exact alignment of the two elongated recesses 180 may vary somewhat as long as they allow for the through opening 210 as described to be formed. The through opening 210 described above may in this embodiment of the invention form the secondary yarn strand guide 130, which will consequently be movable back and forth in the longitudinal direction 190 of the hollow elongated element 150 via the movability of the elongated body 170. In FIGS. 1 and 2 the primary yarn strand guide 120 can be seen as provided on the outer surface 151 of the hollow elongated element and located between at least two possible locations of the though opening 210 in the longitudinal direction 190 of the hollow elongated element 190. The primary yarn strand guide 120 is in FIGS. 1 and 2 shaped as two pins 121 protruding from the outer surface 151 of the hollow elongated element 150.

Figure 3:
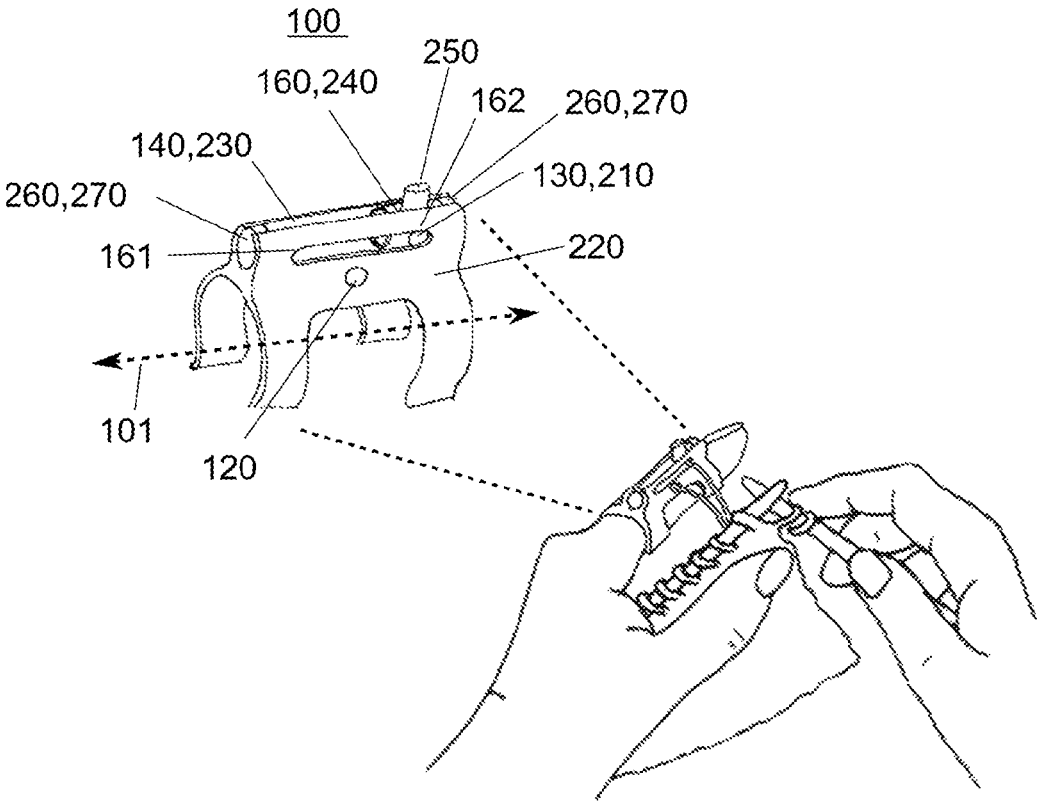
FIG. 3 is a schematic representation of a finger cuff comprising a primary yarn strand guide and a finger cuff elongated part aligned in the longitudinal direction of the finger cuff, where the primary yarn strand guide is provided in the finger cuff elongated part.

FIG. 3 illustrates a finger cuff 100 wherein the finger cuff 100 comprises a finger cuff elongated part 220. The finger cuff elongated part 220 can here be seen as aligned in the longitudinal direction 101 of the finger cuff 100 and placed such that it will be adjacent to a user's finger when the finger cuff is being worn. The finger cuff elongated part 220 is further provided with a through hole that may be considered as a stationary primary yarn strand guide 120. FIG. 3 further illustrates a finger cuff 100 wherein the rail 140 comprises a cart track 230, and wherein the rail body 160 comprises a rail cart 240. It will be appreciated that the term cart track 230 and rail cart 240 here may be interpreted broadly, but that one may generally consider a rail cart 240 as an object moveable on the cart track 230, where the rail cart 240 is shorter in extent than the cart track 230 in the longitudinal direction of the cart track 230. A rail cart 240 may for example be considered as a cart that may move through employment of a transport mechanism such as wheels, magnetic levitation, sliding mechanism or similar. It will also be appreciated by a person skilled in the art with knowledge of the present invention that the finger cuff elongated part 220 may take a variety of shapes, but that it in general is elongated in the longitudinal direction 101 of the finger cuff, i.e. the direction of a finger when worn on a such.

FIG. 1-3 illustrates a finger cuff 100 where the rail body 160 is provided with an engagement point 250. The engagement point 250 may here be engaged manually using e.g. a knitting pin or a finger such that the rail body 160 can be manually moved along the rail 140. The engagement point 250 may in other words be utilized to move the rail body 160 on/in the rail 140, back and forth between the first rail body position 161 and the second rail body position 162. The rail body 160 may as an alternative to a manual engagement point 250 be provided with electrical moving means configured to move the rail body between the first rail body position 161 and the second rail body position 161 or vice versa. These electrical moving means can for example be an electrical motor or a solenoid mechanism, which e.g. may be controlled using some form of physically or wirelessly connected control mechanism and/or switch. It will be appreciated by a person skilled in the art with knowledge of the present invention that the electrical moving means and the means for controlling such may be implemented in a wide variety of ways, e.g. dependent on the exact shape of the rail 140 and rail body 160. A solenoid mechanism may for example be connected physically to a rail cart 240, where the latter upon activation of the solenoid mechanism may move along a cart track 230 aligned with the acting force direction of the solenoid mechanism.

FIG. 2 illustrates a finger cuff 100 where the rail 140 and/or rail body 160 are/is provided with holding means to prevent the rail body from moving unintentionally between the first rail body position and the second rail body position. The exact form and shape of the holding means may vary, but may e.g. comprise a friction surface, a lock mechanism, a stick mechanism or similar. The holding means are according to one embodiment of the invention magnets, which e.g. may be provided on the rail body and in or in the vicinity of the first and second rail body positions of the rail.

Figure 4:
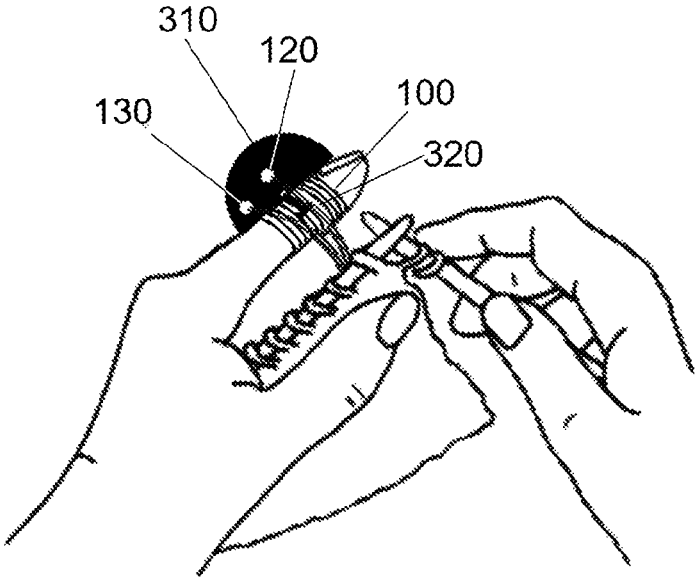
FIG. 4 is a schematic representation of a finger cuff comprising a rotation element and rotation element attachment means.

FIG. 4 illustrates a special embodiment of the invention wherein the transfer mechanism comprises a rotation element 310 that is arranged such that an in-plane vector of the rotation element plane of rotation lies essentially parallel with the longitudinal direction of the finger cuff. Essentially parallel may in this context be interpreted as within 20 degrees or alternatively within 10 degrees of the longitudinal direction of the finger cuff. The primary yarn strand guide and the secondary yarn strand guide 130 are here provided in or on the rotation element 310 itself such that the location of each yarn strand guide in the finger cuff longitudinal direction may be altered by rotating the rotation element 310. Rotation of the rotation element 310 may in other words be said to shift the position of the secondary yarn strand guide between the first secondary yarn strand guide position and the second secondary yarn strand guide position. The motion of the secondary yarn strand guide may here be interpreted as relative to a reference system/space where the location of the primary yarn strand guide is stationary. The rotation element 310 may be fastened to the finger cuff by employing suitable a rotation element attachment means 320, e.g. by employing one or more bearings and an axle.

Figure 5:
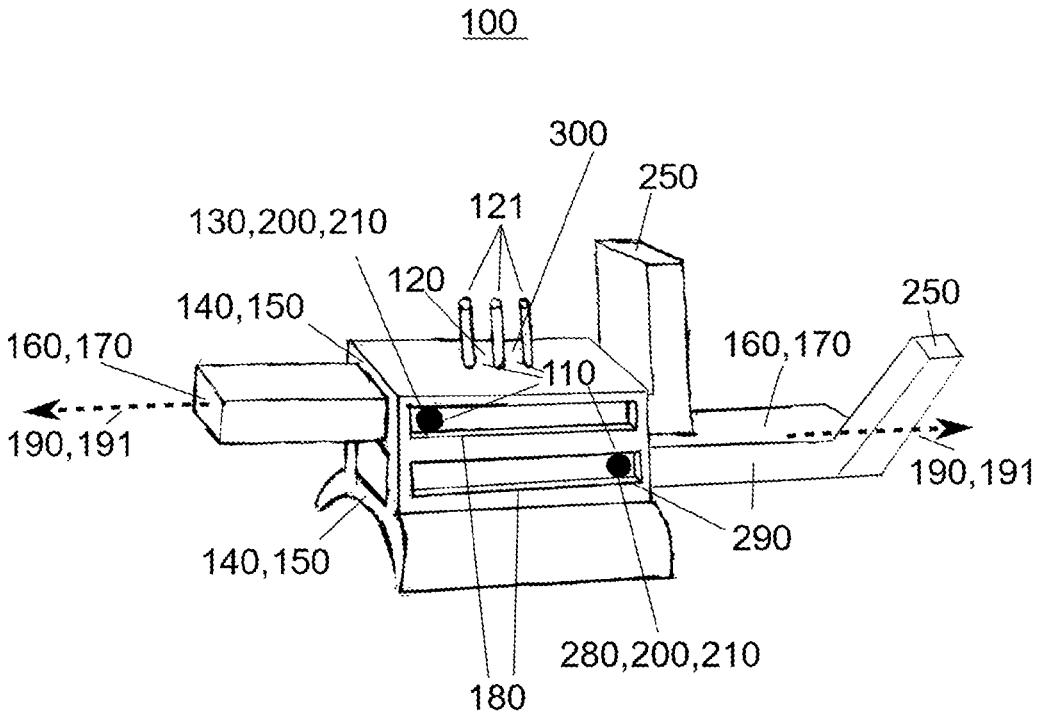
FIG. 5 is a schematic representation of a finger cuff comprising a tertiary yarn strand guide and a second transfer mechanism.

FIG. 5 illustrates a finger cuff 100 according to an embodiment of the invention wherein the finger cuff 100 comprises a tertiary yarn strand guide 280 and a second transfer mechanism 290. The second transfer mechanism 290 may in this embodiment of the invention be of a similar design as any earlier described transfer mechanism according to any embodiment of the invention. The second transfer mechanism 290 is configured to shift the tertiary yarn strand guide 280 in the finger cuff longitudinal direction 101 between a first tertiary yarn strand guide position and a second tertiary yarn strand guide position. The first tertiary yarn strand guide position and the second tertiary yarn strand guide position are according to this embodiment of the invention located on opposite sides of the primary yarn strand guide, and located such that the first tertiary yarn strand guide position and the second tertiary yarn strand guide position are located on opposite sides of first secondary yarn strand guide position or the second secondary yarn strand guide position. The latter configuration allows a user employing the finger cuff to knit with more than two yarns while at the same time with ease handling the all of the yarn strands. A knitter knitting for example with an additional yarn strand (three in total), which is employing the finger cuff, may utilize the second transfer mechanism to additionally exchange the location of the yarn strands in the longitudinal direction of his or her finger. The latter enables the knitter to controllably knit with whichever of the three yarn strands he or she desires while at the same time knit whichever one or more of the three yarn strands that is idle into the knitting. As the knitter may controllably handle the position of the three yarn strands as desired, the three yarn strands will not be tangled up during said knitting process. The various relationships for the locations described for this embodiment may be considered as being relative to the longitudinal direction of the finger cuff.

FIG. 5 illustrates an embodiment of the invention wherein the finger cuff comprises one or more additional yarn strand guides 300. This/these yarn strand guide(s) 300 may be stationary or moveable through the employment of a transfer mechanism as herein described. The one or more additional yarn strand guide(s) 300 may comprise, a pin, grove, through hole, slot or loop. The finger cuff may according to any embodiment of the present invention comprise one or more additional yarn strand guides.

| | |
|---|---|
| 100 | Finger cuff |
| 101 | Longitudinal direction of the finger cuff |
| 110 | Yarn strand guide |
| 120 | Primary yarn strand guide |
| 121 | Pin |
| 130 | Secondary yarn strand guide |
| 140 | Rail |
| 150 | Hollow elongated element |
| 151 | Outer surface of the hollow elongated element |
| 160 | Rail body |
| 161 | First rail body position |
| 162 | Second rail body position |
| 170 | Elongated body |
| 180 | Elongated recess |
| 190 | Longitudinal direction of the hollow elongated element |
| 191 | Longitudinal axis of the hollow elongated element |
| 200 | Through hole or slot |
| 210 | Through opening |
| 220 | Finger cuff elongated part |
| 230 | Cart track |

-continued

| | |
|---|---|
| 240 | Rail cart |
| 250 | Engagement point |
| 260 | Holding means |
| 270 | Magnet |
| 280 | Tertiary yarn strand guide |
| 290 | Second transfer mechanism |
| 300 | Additional yarn strand guide |
| 310 | Rotation element |
| 320 | Attachment means |

The invention claimed is:

1. A finger cuff for handling yarn strands when knitting with multiple yarns simultaneously, the finger cuff comprising:

a primary yarn strand guide configured to guide a primary yarn strand from a first side of a finger cuff to second opposing side of the finger cuff;

a secondary yarn strand guide configured to guide a secondary yarn strand from the first side of a finger cuff to the second opposing side of the finger cuff; and a transfer mechanism configured to at least shift the position of the secondary yarn strand guide in the finger cuff longitudinal direction between a first secondary yarn strand guide position and a second secondary yarn strand guide position, where the first secondary yarn strand guide position and the second secondary yarn strand guide position are located on opposite sides, in the finger cuff longitudinal direction, of the primary yarn strand guide.

2. A finger cuff for handling yarn strands when knitting with multiple yarns simultaneously, the finger cuff comprising:

a primary yarn strand guide;

a secondary yarn strand guide; and a transfer mechanism configured to at least shift the position of the secondary yarn strand guide in the finger cuff longitudinal direction between a first secondary yarn strand guide position and a second secondary yarn strand guide position, where the first secondary yarn strand guide position and the second secondary yarn strand guide position are located on opposite sides, in the finger cuff longitudinal direction, of the primary yarn strand guide, wherein the transfer mechanism comprises:

a rail aligned at least in part along the longitudinal direction of the finger cuff; and a movable rail body, movable on the rail between a first rail body position and a second rail body position, where the secondary yarn strand guide is provided on or in the moveable rail body, and where the secondary yarn strand guide is positioned in the first secondary yarn strand guide position when the rail body is located in the first rail body position, and where the secondary yarn strand guide is positioned in the second secondary yarn strand guide position when the rail body is located in second rail body position.

3. The finger cuff according to claim 2, wherein the rail comprises a hollow elongated element provided with two elongated recesses positioned diametrically opposite of each other and aligned in the longitudinal direction of the hollow elongated element, the primary yarn strand guide is provided on the outer surface of the hollow elongated element, the movable rail body comprises an elongated body provided with a transverse through hole or slot, where the elongated body is configured to move in the longitudinal direction of the hollow elongated element within the hollow elongated element, and the transverse through hole or slot of the elongated body is alignable with the two elongated recesses of the hollow elongated element to form the secondary yarn strand guide.

4. The finger cuff according to claim 2, wherein the finger cuff further comprises a finger cuff elongated part aligned in the longitudinal direction of the finger cuff, the finger cuff elongated part is provided with the primary yarn strand guide, the rail comprises a cart track, and the movable rail body comprises a rail cart configured to be moveable along the cart track.

5. The finger cuff according to claim 2, wherein the rail body is provided with an engagement point engageable with a knitting pin or a finger such that the rail body may be manually moved between the first rail body position and the second rail body position or vice versa.

6. The finger cuff according to claim 2, wherein the rail body is provided with electrical moving means configured to move the rail body between the first rail body position and the second rail body position or vice versa.

7. The finger cuff according to claim 6, wherein the electrical moving means is a solenoid mechanism or electrical motor.

8. The finger cuff according to claim 2, wherein the rail and/or rail body is provided with holding means to prevent the rail body from moving unintentionally between the first rail body position and the second rail body position.

9. The finger cuff according to claim 8, wherein the holding means are magnets.

10. The finger cuff according to claim 1, wherein the transfer mechanism comprises:

a rotation element attachment means, and a rotation element, provided on the rotation element attachment means, where the primary yarn strand guide and the secondary yarn strand guide is provided in or on the rotation element, and where rotation of the rotation element shifts the position of the secondary yarn strand guide between the first secondary yarn strand guide position and the second secondary yarn strand guide position.

11. The finger cuff according to claim 1, wherein the finger cuff comprises one or more additional yarn strand guides.

12. A finger cuff for handling yarn strands when knitting with multiple yarns simultaneously, the finger cuff comprising:

a primary yarn strand guide;

a secondary yarn strand guide;

a transfer mechanism configured to at least shift the position of the secondary yarn strand guide in the finger cuff longitudinal direction between a first secondary yarn strand guide position and a second secondary yarn strand guide position, where the first secondary yarn strand guide position and the second secondary yarn strand guide position are located on opposite sides, in the finger cuff longitudinal direction, of the primary yarn strand guide;

a tertiary yarn strand guide, and a second transfer mechanism configured to shift the tertiary yarn strand guide in the finger cuff longitudinal direction between a first tertiary yarn strand guide position and a second tertiary yarn strand guide position, where the first tertiary yarn strand guide position and the second tertiary yarn strand guide position are located on opposite sides of the primary yarn strand guide, and where the first tertiary yarn strand guide position and the second tertiary yarn strand guide position are located on opposite sides of first secondary yarn strand guide position or the second secondary yarn strand guide position.

13. The finger cuff according to claim 1, wherein any one or more yarn strand guide comprise(s) a pin, grove, through hole, slot or loop.

14. The finger cuff according to claim 1, wherein the primary yarn strand guide is above the secondary yarn strand guide.

* * * * *